US007278351B2

(12) United States Patent
Sugiyama et al.

(10) Patent No.: US 7,278,351 B2
(45) Date of Patent: Oct. 9, 2007

(54) PLATE-MAKING METHOD AND PLATE-MAKING APPARATUS FOR STENCIL PRINTING AND STENCIL PRINTING MACHINE

(75) Inventors: Yoshihide Sugiyama, Wakayama (JP); Yasunari Okagaito, Wakayama (JP)

(73) Assignee: Duplo Seiko Corporation, Wakayama (JP)

( * ) Notice: Subject to any disclaimer, the term of this patent is extended or adjusted under 35 U.S.C. 154(b) by 0 days.

(21) Appl. No.: 10/485,460

(22) PCT Filed: Jul. 30, 2002

(86) PCT No.: PCT/JP02/07698

§ 371 (c)(1),
(2), (4) Date: Sep. 17, 2004

(87) PCT Pub. No.: WO03/013855

PCT Pub. Date: Feb. 20, 2003

(65) Prior Publication Data

US 2005/0016395 A1 Jan. 27, 2005

(30) Foreign Application Priority Data

Aug. 2, 2001 (JP) ..... 2001-234856
Jan. 11, 2002 (JP) ..... 2002-004568

(51) Int. Cl.
*B41C 1/14* (2006.01)

(52) U.S. Cl. ..... 101/128.4; 101/129

(58) Field of Classification Search ..... 101/129, 101/128.4, 114

See application file for complete search history.

(56) References Cited

U.S. PATENT DOCUMENTS 3,587,459 A 6/1971 Spencer et al.
5,243,906 A * 9/1993 Okusawa ..... 101/128.21

(Continued)

FOREIGN PATENT DOCUMENTS

| | | |
|---|---|---|
| EP | 1 053 869 A2 | 11/2000 |
| EP | 1 080 926 A2 | 3/2001 |
| JP | 51-499 | 8/1976 |
| JP | 02-067133 | 3/1990 |
| JP | 02-158391 | 6/1990 |
| JP | 04-173835 | 6/1992 |
| JP | 04-265759 | 9/1992 |
| JP | 06-320700 | 11/1994 |
| JP | 06-328652 | 11/1994 |
| JP | 2001-212925 A | 8/2001 |

OTHER PUBLICATIONS

Supplementary European Search Report issued Oct. 6, 2006 in corresponding EP Application No. 02751773.9—2304.

*Primary Examiner*—Anthony H. Nguyen
(74) *Attorney, Agent, or Firm*—Buchanan Ingersoll & Rooney PC

(57) ABSTRACT

A plate-making method for stencil printing in which heat-sensitive stencil plate material for stencil printing consisting of a thermoplastic resin film is melted by heating of a thermal head to perforate an ink permeable openings includes forming recesses on one side of the film. An opposite side to the one side of the film is heated so that the heated portion is melted for communication with the recesses to form ink permeable openings.

17 Claims, 7 Drawing Sheets

U.S. PATENT DOCUMENTS 5,245,932 A * 9/1993 Ujiie ..... 101/128.4
5,384,585 A * 1/1995 Okumura ..... 347/206
5,592,209 A * 1/1997 Hasegawa et al. ..... 347/206
5,617,787 A * 4/1997 Takita et al. ..... 101/129
5,685,222 A 11/1997 Yokoyama et al.
5,908,687 A * 6/1999 Mori ..... 428/215
6,037,958 A * 3/2000 Terauchi et al. ..... 347/171
6,096,374 A * 8/2000 Ohta et al. ..... 427/148
6,362,846 B1 * 3/2002 Nakamura ..... 347/171
6,446,551 B1 * 9/2002 Watanabe ..... 101/128.4
6,460,454 B1 * 10/2002 Oike et al. ..... 101/128.4

* cited by examiner

PLATE-MAKING METHOD AND PLATE-MAKING APPARATUS FOR STENCIL PRINTING AND STENCIL PRINTING MACHINE

TECHNICAL FIELD

The present invention relates to a thermal plate-making for stencil printing, especially, the plate-making method and the plate-making apparatus for stencil printing and the stencil printing machine which realize plate-making by using a stencil plate material consisting only of a thermoplastic resin film substantially without ink-permeable supporters, such as Japanese paper and nonwoven fabric etc. In addition, the above expression of "consisting only of a thermoplastic resin film substantially" intends to include such a construction of the film that antistatic coating and weld prevention coating may be given on a surface of the film, on condition that it have no ink-permeable supporter.

BACKGROUND ART

Conventionally, a stencil sheet, which is utilized for a stencil plate in stencil printing, generally comprises an ink-permeable supporter and a thermoplastic resin film which is stuck on the supporter with adhesives. The ink-permeable supporter is made of Japanese paper or nonwoven fabric and the like. The thermoplastic resin film is made from polyester and the like. A thickness of the thermoplastic resin film is 1.5 μm to generally a thickness of the supporter being about 30-40 μm. Printing is performed by taking out ink from a stencil plate which is formed by thermally perforating the film. Said thermal perforation is mainly performed by heating of a thermal head, namely, said stencil sheet is inserted between the thermal head and a platen roller, and then is heated by the thermal head.

Respect to stencil printing performed by using such a stencil plate made or engraved by the above mentioned method, from before, various inconveniences or disadvantages of using the stencil plate which is stuck the thermoplastic resin film with adhesives, are mentioned. Meanwhile, various improvement proposals, which constitute a stencil plate only of a thermoplastic resin film without supporters, are proposed. However, none of the proposals has resulted in utilization now, and any proposals must overcome certain technical problems. When the stencil plate particularly is constituted only of a thermoplastic resin film, it is hard to deal with the stencil plate if a thickness of the film is not made to some extent thick. In addition, it is necessary to enlarge an output force of the thermal head in order to carry out thermally perforating at the thick film. That caused various problems and has become the greatest difficulty of utilization.

On the other hand, it is preferable that perforations of the stencil plate made in stencil printing are perforated independently for every dot, and for that, it is desirable to make heater size as small as possible to a dot pitch as shown in the Japanese examined patent publication No.2732532. However, corresponding to a size of the heater becoming small, an influence of a heat diffusion which the heater receives from the circumference electrodes becomes large, thereby, a thermal efficiency of the thermal head falls down and a life of the thermal head becomes short. Furthermore, with respect to a thin film type thermal head, since an exothermic portion is dented compared with a surrounding electrode, the stencil sheet will be supported by high electrode sections around of the dented portion according to the size of the heater becoming small. Therefore, a contact state or an adhesion state between the exothermic portion and the stencil sheet becomes bad, and thermal efficiency falls increasingly.

Moreover, in order to solve the above-mentioned problem about aggravation of the contact state between the exothermic portion and the stencil sheet by the size of the heater becoming small, the thermal head so called a "partial glaze type" which raises only the exothermic portion by glaze is proposed.

However, even if the thermal head is the partial glaze type, since an upheaval of the partial glaze is very smooth, the raising curve also turns into a straight line in approximation. After all, it becomes not impossible to fully solve the problem of the adhesion.

SUMMARY OF INVENTION

As mentioned above, the problem of the stencil sheet for stencil printing and the problem of the thermal head for stencil printing are independent respectively. The present invention is originated that those problems should be solved in simultaneous. Therefore, the present invention tends to provide with a method and an apparatus for plate-making and a stencil printing machine which can realize a stencil plate printing by constituting the stencil sheet(plate) only of a thermoplastic resin film, in a stencil plate printing.

First, the plate-making method for stencil printing according to the present invention solves the technical problems of the conventional arts, and in order to attain the purpose of it, it is constituted as follows. Namely, the plate-making method for stencil printing according to the present invention which forms ink-permeable openings by thermally fusing a heat-sensitive stencil plate material for stencil printing which consists of an extended thermoplastic resin film with a predetermined thickness is characterized in that: a tensile stress at the time of extension is internally remained and many minute recesses are formed on one side surface of the above film, an opposite side surface to the minute recess side of the film is heated by the thermal head, an energy output of the thermal head for heating sufficiently satisfies to fuse-penetrate a thin closing portion of the minute recess, but it is restricted to the range which does not fuse-perforate a thick portion except the recess portion of the film, so that said openings are formed by the heated fused portion communicating with the minute recess.

Two or more heaters are arranged in the main scanning direction at one sequence or tier on the thermal head. When a main scanning side array pitch of the heater is set to PM, a main scanning side heater length is set to HM, a sub scanning side delivery pitch is set to PS and a sub scanning side heater length is set to HS, it is desirable that a size of the heater satisfies HM>0.6PM and HS>0.7PS.

It is desirable that impression energy of the thermal head is below into the 35 milli-joule/$mm^2$ in this plate-making.

Moreover, in this plate-making method, the stencil plate material consists of an extended film in which a tensile stress at the time of extension remains. Therefore, when the heated portion begins to melt, a base of the melting portion is communicated with the minute recess, so that the ink-permeable perforation is formed by the stress.

Furthermore, in this method for stencil printing, it is desirable that the stencil plate material is constituted of an extended polyethylene-terephthalate(PET) film or an extended low melting point film by copolymerizing polyethylene terephthalate(PET) and polybutylene terephthalate (PBT), and when a working temperature is set to t° C., a melting point of the film is to set m° C. and a glass transition point is set to g° C., it is preferable that the templating (or impressing) is performed by P Pa of working pressure force of $10^4 \times 10^{2(m-t)/(m-g)}$ or more.

The minute recess may be a penetrated hole of which a diameter of an opening on the heated side of the film is smaller than a diameter of an opening on the opposite side to said heated side, and the diameter the opening on the heated side is small not to permit ink-permeating.

Moreover, the minute recess may be a dent which reduces the thickness of the film partially and forms a thin closing portion.

Next, the plate-making apparatus for stencil printing according to the present invention is constituted as follows. Namely, the apparatus comprises a plate feed section which feeds the heat-sensitive stencil plate material consisting of an extended thermoplastic resin film with a predetermined thickness, a means to form many minute recesses on one side surface of the film, and a heating means to form ink-permeable openings in the film by heating the film, in which an opposite side surface to the minute recess side of the film is heated by the heating means, a tensile stress at the time of extension is internally remained in said thermoplastic resin film, an energy output of the heating means for heating sufficiently satisfies to fuse-penetrate a thin closing portion of the minute recess, but it is restricted to the range which does not fuse-penetrate a thick portion except the recess portion of the film, so that said openings are formed by the heated fused portion communicating the minute recess.

This heating means is a thermal head on which two or more heaters are arranged in the main scanning direction at one sequence or tier, and when a main scanning side array pitch of the heater is set to PM, a main scanning side heater length is set to HM, a sub scanning side delivery pitch is set to PS and a sub scanning side heater length is set to HS, it is desirable that a size of the heater satisfies HM>0.6 PM and HS>0.7 PS and an output energy of the thermal head is below into the 35 milli-joule/$mm^2$.

Of course, it is also possible to constitute the stencil printing machine equipped with the above plate-making apparatus for stencil printing as a plate-making section.

Also, in any case of the plate-making apparatus and the stencil printing machine, the minute recess can be made into a penetrated hole that a diameter of an opening on the heated side of the film is smaller than a diameter of an opening on the opposite side to said heated side, and the diameter the opening on the heated side is small not to permit ink-permeating.

The present invention makes it possible to thermally perforate individual ink-permeable openings in the film independently without increasing an output of a thermal head, and it realizes the stencil printing by using the stencil plate material consisting only of a thermoplastic resin film. Thereby, the problem about the stencil sheet (stencil plate material) and the problem about the thermal head are solved simultaneously.

DETAILED DESCRIPTION

Figure 1:
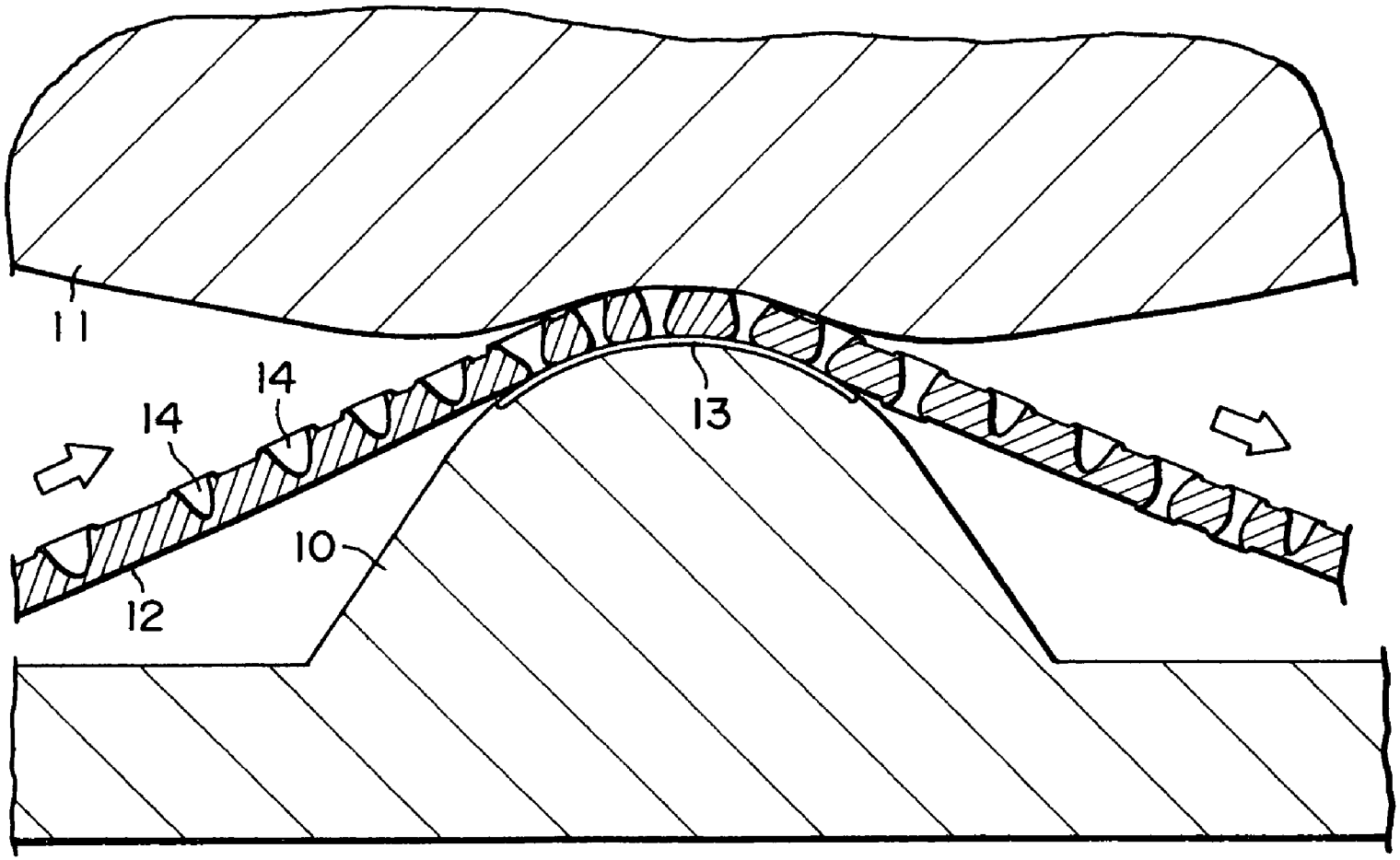
FIG. 1 is a drawing showing a concept of the plate-making method and the apparatus for according to the present invention.

Referring to FIG. 1 to FIG. 9, embodiments of the plate-making method and the apparatus for stencil printing and the stencil printing machine according to the present invention will be described hereunder. FIG. 1 is an outline drawing illustrating the plate-making method for stencil printing according to the present invention. In FIG. 1, the numeral 10 designates a thermal head, and the numeral 11 designates a platen roller. A stencil sheet 12 consisting of an extended polyethylene-terephthalate (PET) film is sent to the right-side from the left-side in the direction of an arrow of FIG. 1. Although FIG. 1 is an enlarged sectional view, an actual size of each composition, for example a thickness of the stencil sheet 12 is about several μm, and a length of a heater section 13 of the thermal head 10 is about 10 μm to 20 and several μm in a stencil sheet feed direction. Moreover, although the platen roller 11 is partially shown in FIG. 1, it is a rubber roller which has a diameter about 20 mm.

In addition, other thermoplastic resin usable as the film is mentioned, for example, polyethylene-terephthalate resin, polyethylene resin, polyvinyl chloride resin, polyvinylidene chloride resin, poly methyl pentene resin, polypropylene resin, polyethylene-naphthalate resin, polyvinyl alcohol resin, nylon 6. When using especially a polyester film, it is preferable to use the above polyethylene-terephthalate (PET) film, a polyethylene-terephthalate (PET) film with 20% or less of crystallinity, an extended low melting point film by copolymerizing polyethylene terephthalate (PET) and polybutylene terephthalate (PBT), or a low melting point film by copolymerizing polyethylene terephthalate (PET) with 20% or less of crystallinity and polybutylene (PBT).

Many minute or micro recesses 14 are formed on one side surface of the stencil sheet 12 by random arrangement. Said side is in contact with the platen roller 11. FIG. 1 shows a state where the thermal head 10 is electrified so that a portion of the stencil sheet 12, which is in contact with the heater section 13, is perforated. The stencil sheet 12 is penetrated by fusing a bottom of the minute recess 14, and an ink permeable opening is formed. Thus, the ink permeable opening can be formed in a desired part to make plate by controlling an electrification to the heater section 13 of the thermal head 10, whether ON or OFF.

Thus, since the minute recesses 14 are formed on the one side surface of the film stencil sheet 12, when the stencil sheet 12 is heated and perforated from an opposite side of it, it will become possible to form ink-permeable openings by fusing and penetrating only the bottom portion of the recess 14, without penetrating all the thickness of the film.

A density in which the minute recess 14 is formed can be changed according to desired resolution. As for the density of the recesses 14, it is suitable that a rate of opening becomes about 5-30% per 1 dot, to bring beautiful printing, and prevent a back projection and a strike-through. That is, the area of the film which is in contact with one heater section 13 of the thermal head 10 is equivalent to 1 dot of a matrix and it must to arrange at least one minute recess 14 in the area.

Moreover, although an array of the minute recess 14 may be regular, it is preferable that the array is irregular within fixed limits responding to a desired rate of opening so as to prevent a phenomenon of "moire". The phenomenon of "moire" means that a shade of ink appears in the shape of stripes on a print sheet. In the case of any, the average pitch of the minute recess 14 is set finer than the array pitch of the heater section 13 of the thermal head 10.

Figure 2:
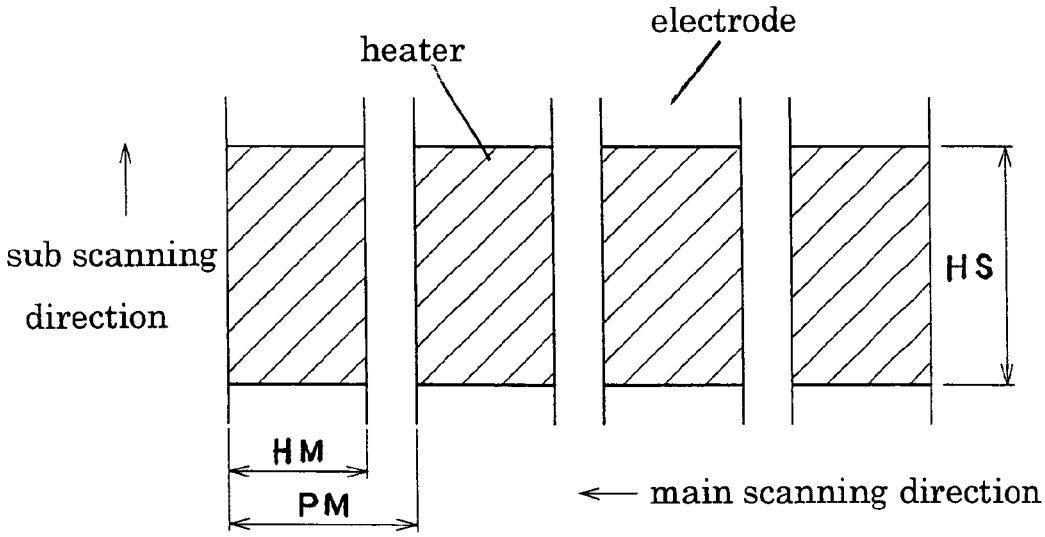
FIG. 2 is a drawing showing a front view of the array state of the heater section of the thermal head.

FIG. 2 is a plan view showing an array state of the heater section of the thermal head. Two or more heaters are arranged to main scanning direction at the single tier, and the main scanning side array pitch of the heater is PM, the main scanning side heater length of it is HM, the sub scanning side delivery pitch of it is PS, and the sub scanning side heater length is HS. In this case, the main scanning side heater length is longer than 0.6 times of the main scanning side array pitch, and the sub scanning side heater length is longer than 0.7 times of the sub scanning side array pitch. Even if the heater size becomes such large size, a perforation does not become large in connection with it. It is the reason that the plate-making is performed in use a stencil sheet material consisting only of a thermoplastic resin film which have the many minute recesses on one side surface of it, and the output energy of the thermal head for heating sufficiently satisfies to fuse a thin closing portion of the minute recess, but it is restricted to the range which does not fuse-perforate a thick portion except the recess portion of the film. If a perforation equal to the heater size is formed carried out like the conventional plate-making machine of the conventional stencil, a diameter of the perforation becomes large in connection with the heater size becoming large, finally, the perforation is communicated with the next perforation. In such case, even if the "O" character is printed, the character may be smeared away like "●".

Figure 3:
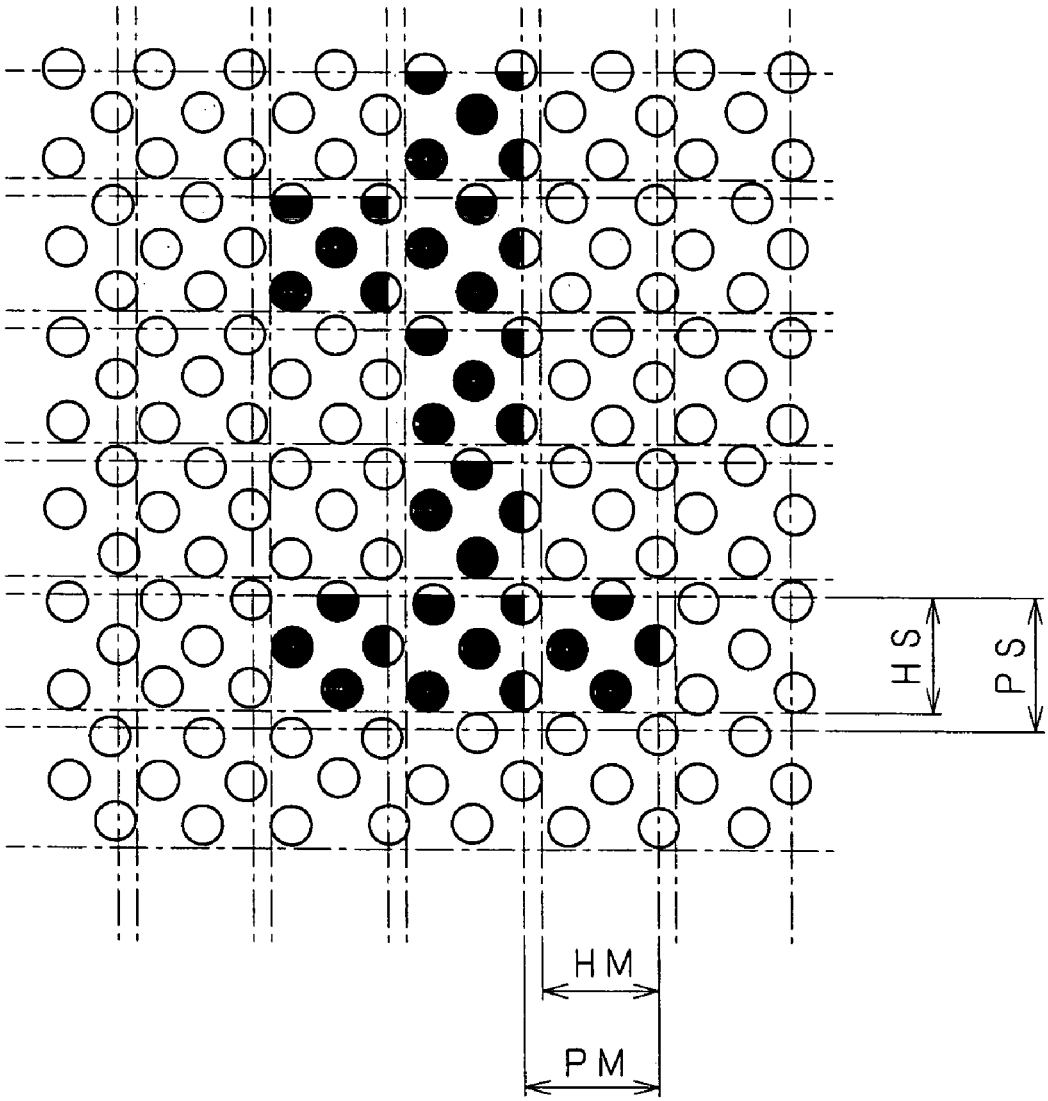
FIG. 3 is a drawing showing a state of the stencil plate which is perforated by making the heater of the position which expresses "1" of a number according to this plate-making method generate heat, and above mentioned process is performed by means of the plate-making method according to the present invention.

The output energy of the thermal head is below 35 milli joule/mm$^2$ at the time of plate-making. The above perforations are independent altogether since they are formed using the recesses. FIG. 3 shows a state of the stencil plate which is perforated by making the heater of a position which expresses "1" of a number according to this plate-making method generate heat. Some perforations which are perforated by heating of the thermal head are smeared away black. Thus, since each perforation can be formed independently without making the heater size small, a large size heater with sufficient thermal efficiency also with little influence of thermal diffusion can be adopted. If the heater size can furthermore be enlarged, a contact nature between the film and the heater can be improved by fully taking advantage of the effect of raising by the heater (heating element) of the partial glaze type, and a thermal efficiency will become still better. Especially, since the heater size in the sub scanning direction is enlarged, the merit (improvement of the contact nature by raising) of using the partial glaze type becomes large.

Figure 4:
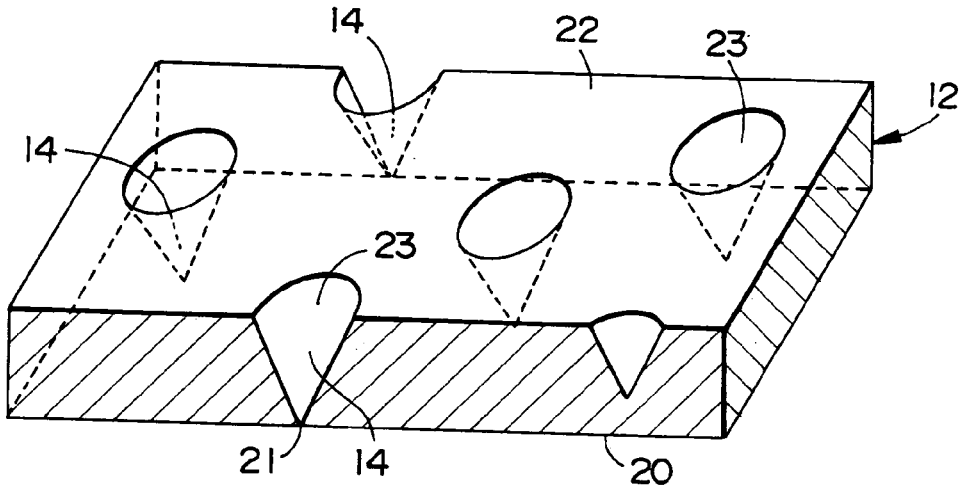
FIG. 4 is a drawing showing a concept about the structure of the stencil sheet used for the plate-making method and apparatus according to the present invention.
Figure 5:
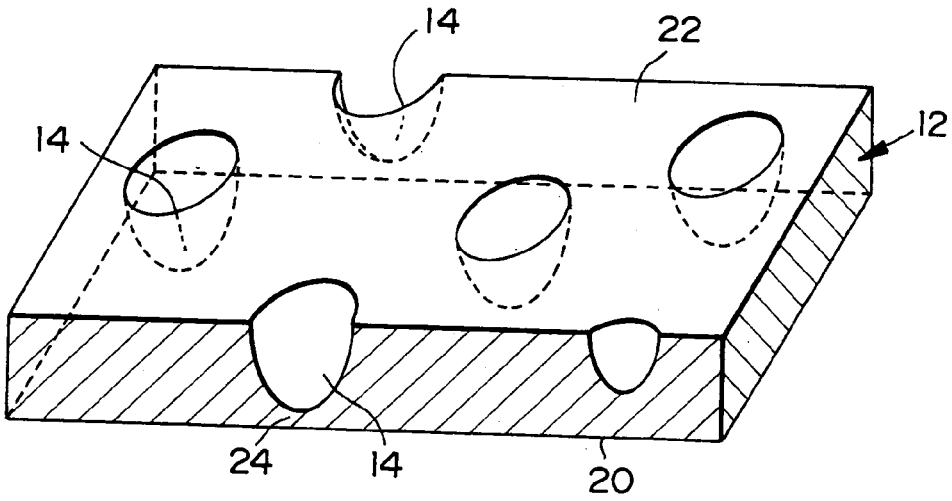
FIG. 5 is a drawing showing a concept about the structure of the stencil sheet used for the plate-making method and apparatus according to the present invention.

FIG. 4 is a sectional perspective view showing the stencil sheet 12 in which the minute recess is a penetrated hole, but said hole is small not to permit ink permeability. Although an opening 21 on a surface 20 which is heated at the time of plate-making is so small not to permit ink permeability, an opening 23 on a surface 22 of an opposite side may be larger than it, and may be large so that the ink enter into the minute recess 14. In addition, FIG. 3 shows a situation that the minute recess 14 is formed in the shape of a dent with a thin bottom 24.

Moreover, when the minute recess 14 is formed in the shape of the dent, it is preferable that the thickness of the thin bottom 24 is about 80% or less of the thickness of the film, but said the thickness rate depends on material of the film. In addition, a residual stress may occur at the time of the extension of the film, and said stress may concentrate on the minute recess of the surface to urge opening, in that case, it is effective also in the recess of about 20% of the depth of the film thickness. On the other hand, when little residual stress occurs at the time of the extension of the film, it is necessary to make the depth of the recess deep (for the thickness of the thin bottom to be thin), in that case, it is preferable that the thickness of the thin bottom is about 2 μm or less.

Following experiments were carried out in order to search for the proper heater size of the thermal head and plate-making energy of the thermal head. The used film is an extended low melting point film by copolymerization with a thickness of 6 μm of PET and PBT. Photo etching with a depth of 18 μm is performed to a surface of a stainless steel board with the thickness of 0.2 mm, thereby, such templating material can be obtained that has many circular minute projections having a diameter of 40 μm and a height of 18 μm, and arranged in 30 μm pitch each other's. Each above-mentioned film was put on said templating material, respectively, and was passed through between a pair of iron rollers with the diameter of 100 mm and the length of 200 mm length. The working temperature is set to 25° C., and the working pressure between rollers is set to 200 million Pa (2t/mm$^2$). The thermal head used in experiments is as follows.

Thermal head A: 400 DPI of partial glaze, the heater size in the main scanning direction is 3 μm and the heater size in the sub scanning direction is 40 μm. Thermal head B: 400 DPI of partial glaze, the heater size in the main scanning direction is 30 μm and the heater size in the sub scanning direction is 80 μm. Thermal head C: 400 DPI of partial glaze, the heater size in the main scanning direction is 47 μm and the heater size in the sub scanning direction is 80 μm. Thermal head D: 400 DPI of partial glaze, the heater size in the main scanning direction is 47 μm and the heater size in the sub scanning direction is 100 μm. The plate-making tests were carried out according to such conditions that the repeat period per line was set to 2 mSec(s), the printing pulse width was set to 500 μSec, and the output energy was set to 10-35 milli-joule/mm2. Table 1 shows the experimental result. In this case, said output energy means an energy consumed by 1 time of the pulse, per 1 mm2 of the heater of the thermal head. When an applied voltage of the heater is set to V (volt), an electric resistance of the heater is set to R (ohm), the main scanning direction length of the heater is set to HM (mm), the sub scanning direction length of the heater is set to HS (mm), a pulse width is set to T (Sec) and an energy per 1 mm2 is set to E(joule), said joule E is expressed with E=T(V2/R)/(HM·HS).

TABLE 1

| | plate-making energy | judgment | situation of plate-making |
|---|---|---|---|
| thermal head A (HM = 0.47) (HS = 0.62) | 15 mili-joule/mm$^2$ | X | no perforation |
| | 20 mili-joule/mm$^2$ | X | no perforation |
| | 36 mili-joule/mm$^2$ | ▼ | perforation in parts, and some perforations besides recess |
| thermal head B (HM = 0.47) (HS = 1.26) | 15 mili-joule/mm$^2$ | X | no perforation |
| | 20 mili-joule/mm$^2$ | ▼ | a little perforations, and some perforations besides recess (5% of recesses of printing area) |
| | 36 mili-joule/mm$^2$ | X | some perforations also besides recess, perforations become excessive hole by connecting each other |
| thermal head C (HM = 0.74) (HS = 1.26) | 15 mili-joule/mm$^2$ | ○ | clear perforation only to recess (20% of recesses of printing area) |
| | 20 mili-joule/mm$^2$ | ◎ | clear perforation only to recess (60% of recesses of printing area) |
| | 36 mili-joule/mm$^2$ | ▼ | some perforations also besides recess, perforations become excessive hole by connecting each other |
| thermal head D (HM = 0.74) (HS = 1.57) | 15 mili-joule/mm$^2$ | ◎ | clear perforation only to recess (70% of recesses of printing area) |
| | 20 mili-joule/mm$^2$ | ○ | some fusions in part also besides recess, perforations become a little excessive hole by partially connecting each other |
| | 36 mili-joule/mm$^2$ | X | fusions also besides recess, perforations become bery e excessive hole |

In the above evaluation, X mark, ▼ mark, ○ mark and ◎ mark are given based on each state after plate-making.

The X mark means an unclear perforation. Namely, after plate-making, any of perforations by heating of the thermal head could not make ink permeate.

The ▼ mark means that the perforations by heating of the thermal head could make ink permeate but the number of perforations is not enough.

The ○ mark means that the perforations by heating of the thermal head were clear, but the number of the perforations is enough after plate-making.

The ◎ mark means clear perforation. Namely, after plate-making, the perforations by heating of the thermal head were clear and make ink permeate.

The above ○ also means that some perforations occurred in part besides the recesses by an excessive energy. Namely, that considers as an excessive perforating.

The above V mark also means that some perforations occurred in wide part besides the recesses by an excessive energy, and some of them were connected to each other. Namely, that considers as an excessive perforating.

The above X mark also means that some perforations occurred in wide part besides the recesses by an excessive energy, and all of them were connected to each other. Namely, that considers as an excessive perforating.

When the main scanning side array pitch of the heater is set to PM, the main scanning side heater length is set to HM, the sub scanning side delivery pitch is set to PS and the sub scanning side heater length is set to HS, it can be understood that the plate-making in which the thermal head C and D filling the condition formula of the heater "HM>0.6 PM and HS>0.7 PS" is used is excellent compared with the plate-making in which the thermal head A and B not filling the above condition formula is used. Moreover, when the plate-making energy is carried out more than the 30 milli-joule/mm$^2$, the whole film is fuse-penetrated to become indistinct plate-making.

Next, a method for forming the minute recesses 14 on the stencil sheet 12 which consists of a thermoplastic resin film, is described hereunder. A templating or embossing of the film is performed by forcing projections on one side surface of the film. For example, a file-like tool to which many particles of diamond are adhered, can be also used to be forced against the thermoplastic resin film with a predetermined thickness. It is generally difficult to force the projection on a thin film-like sheet so as to form a penetrated hole. In that case, usually, a layer of pellicle state remains on the opposite side of a projection forcing side (namely, it becoming a dent which forms a thin bottom), or it is forced only against the grade in which an opening about a crack (a small opening of the grade which does not permit ink permeability) is formed slightly. If it is processed using this property, the suitable minute recess will be formed on a processing side. Consequently, even if the minute recess reaches the surface of the opposite side, the opening will not become the extent that ink permeability is permitted.

Figure 6:
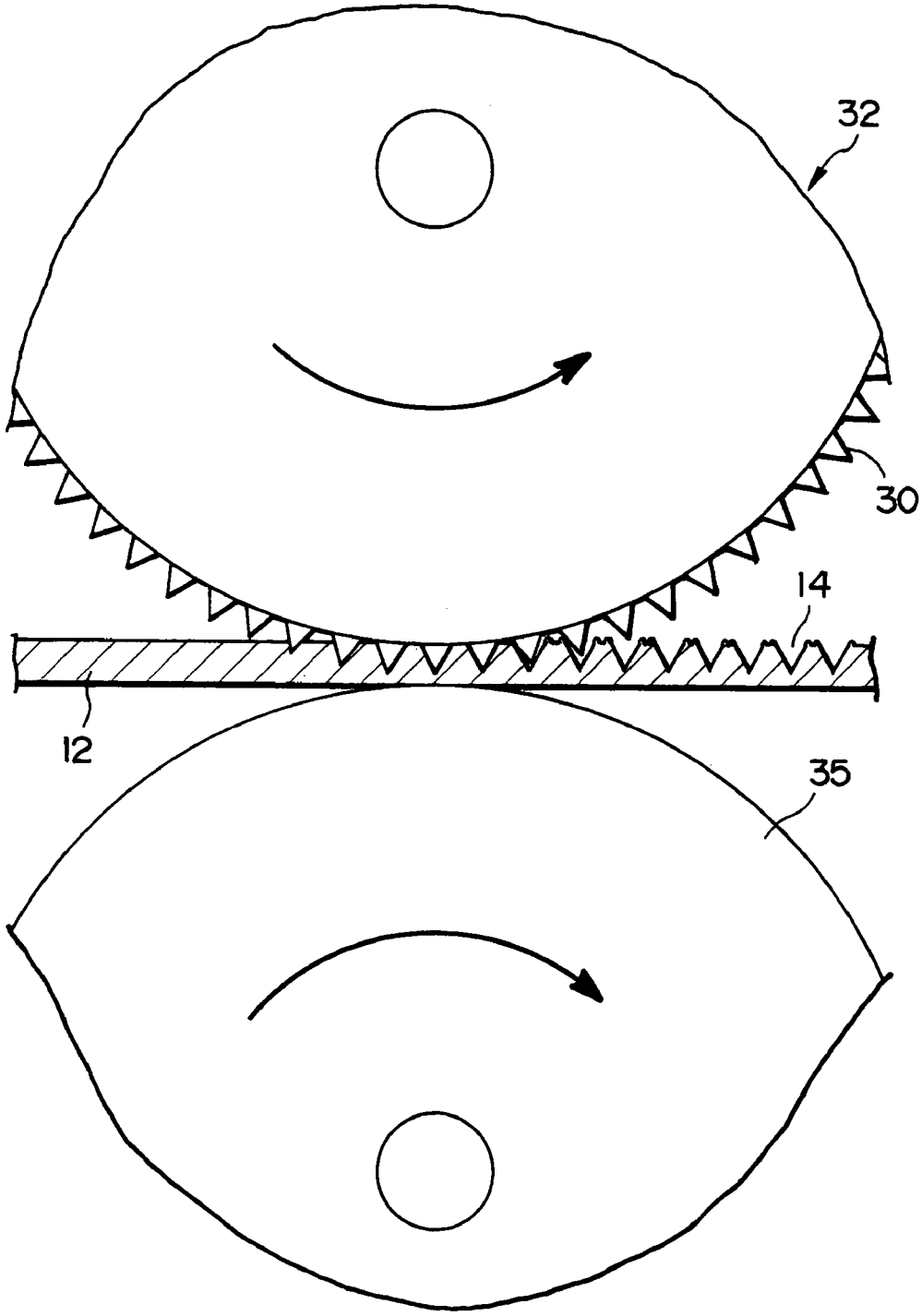
FIG. 6 is a drawing showing an example of a composition for forming minute recesses in the stencil sheet.
Figure 7:
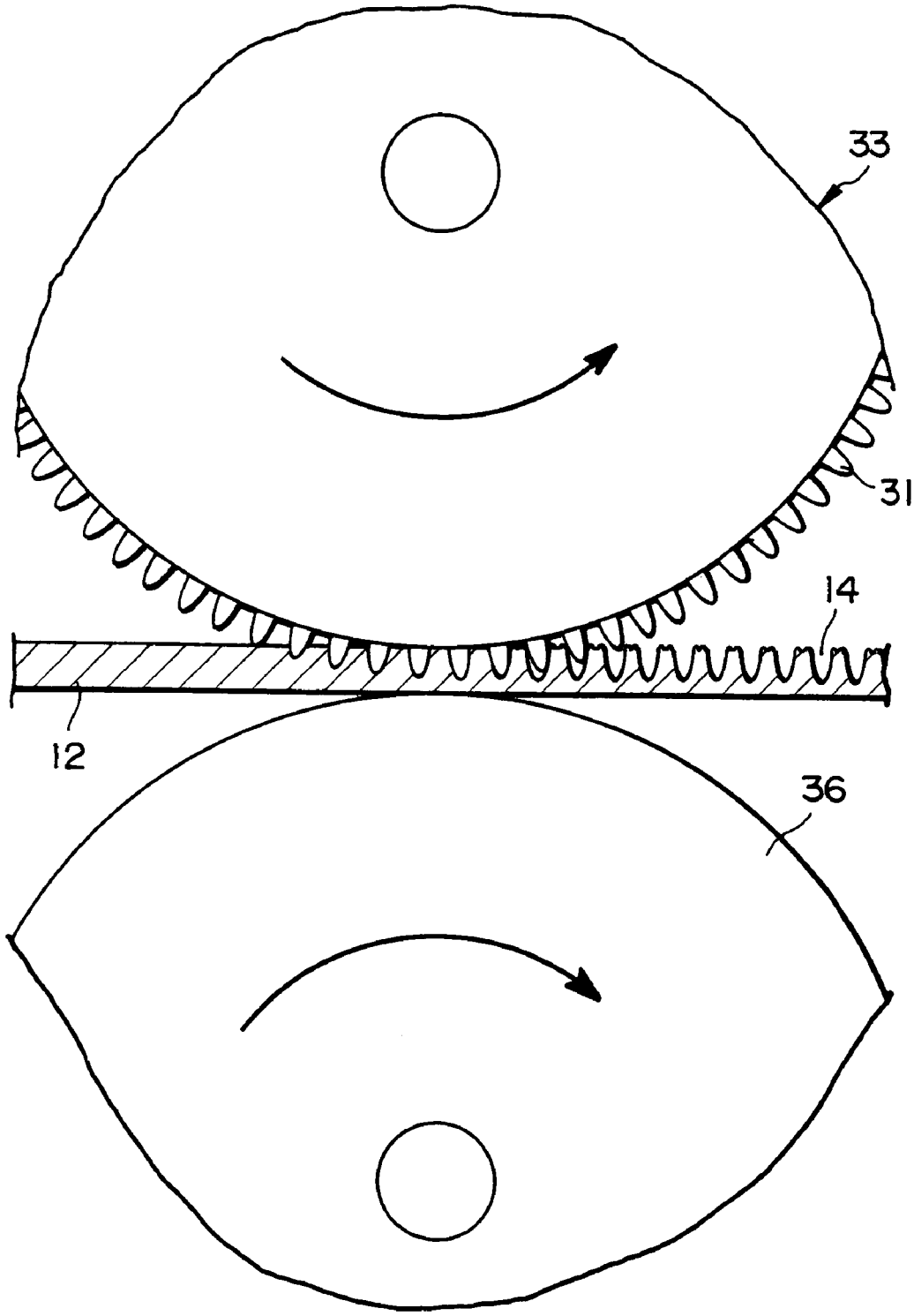
FIG. 7 is a drawing showing an example of a composition for forming minute recesses in the stencil sheet.

FIGS. 6 and 7 shows an embodiment for forming the minute recesses 14. Templating rollers 32, 33 and supporting rollers 35, 36 are arranged so that they counter mutually, the surface of the templating rollers 32, 33 have uneven surfaces to which many particles are adhered, the surface of the supporting rollers 35, 36 have smooth surfaces. The thermoplastic resin film 12 with a fixed thickness is inserted between the rollers 32 and 35 or between rollers 33 and 36 that are both rotating. The minute recesses 14 are formed on the side surface of the thermoplastic resin film which is contact with the templating rollers 32 or 33 by templating, and the shape of each recess becomes the same as the shape of each particle.

As sown in FIG. 7, when the recesses are formed the templating roller 33 to which the particles 31 having comparatively round noses are adhered, the minute recess 14 does not reach even the opposite side surface of the film. On the other hand, as sown in FIG. 6, when the recesses 14 are formed the templating roller 32 to which the particles 31 having a comparatively sharpened nose, the minute recess 14 may reach the opposite side surface of the film. However, in such case, the recess 14 does not become as large as an ink-permeable opening.

Figure 8:
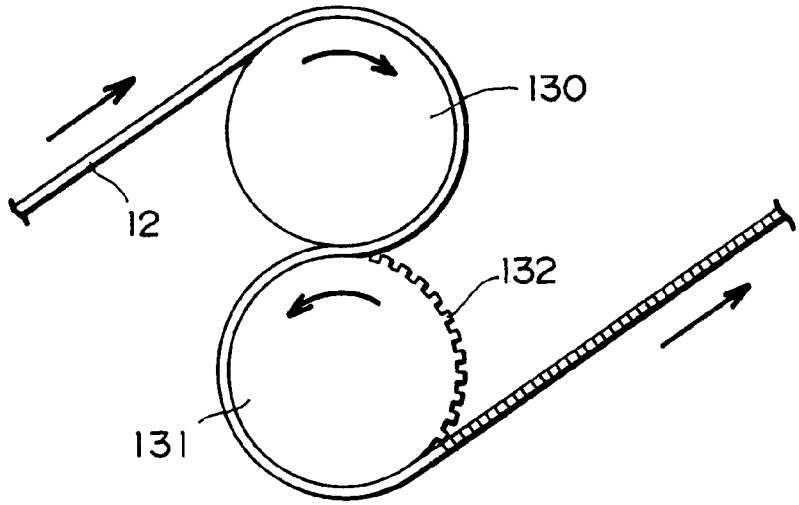
FIG. 8 is a drawing showing an example of a composition for forming minute recesses in the stencil sheet.
Figure 9:
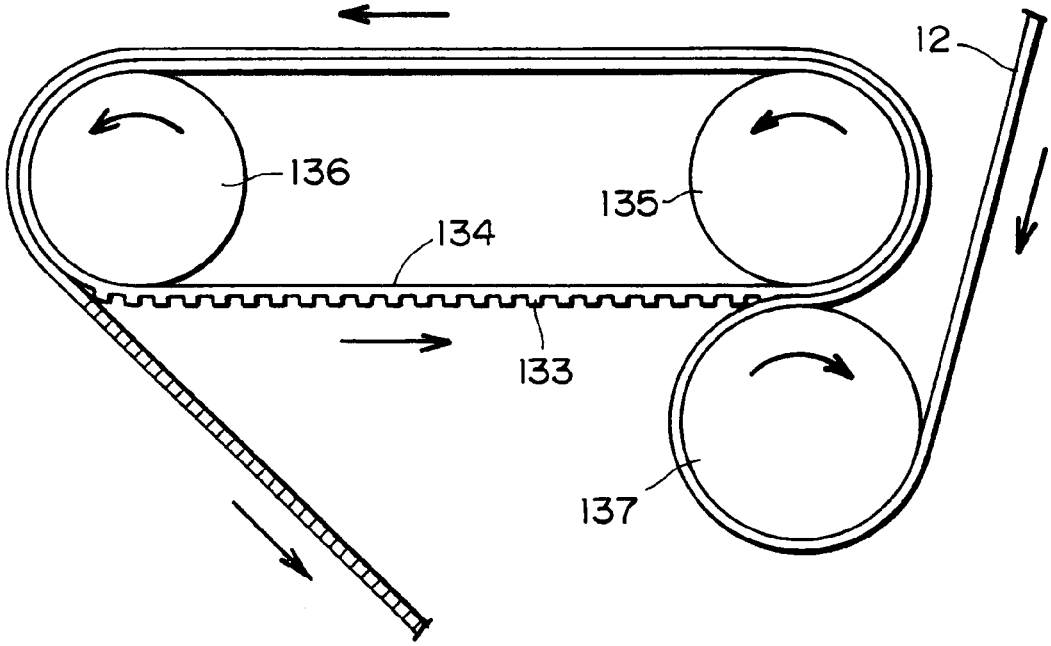
FIG. 9 is a drawing showing an example of a composition for forming minute recesses in the stencil sheet.

Furthermore, FIGS. 8 and 9 shows an embodiment for forming the minute recesses 14 on a polyester film sheet. In FIG. 8, a pair of rollers 130 and 131 are arranged so that they counter mutually. One roller 131 is used as a templating roller, and minute projections are formed on a peripheral face perimeter of the roller 131. Another roller 130 is a supporting roller with a smooth peripheral face. The templating is performed by inserting the thermoplastic resin film 12 with a fixed thickness between the templating roller 131 and the supporting roller 130 which rotate in the direction of an arrow. Working conditions shall fulfill above-mentioned conditions.

FIG. 9 shows a concept of an alternative method and apparatus for producing the stencil plate material. A metal belt 134 is built over between rollers 135 and 136 which rotate and drive. The metal belt 134 has minute projections 133 on the peripheral face perimeter of it. Moreover, a supporting roller 137, which has a smooth peripheral facing the roller 135, is arranged. The templating processing is performed by inserting the thermoplastic resin film 12 with a fixed thickness between the metal belt 134 and the supporting roller 137. Working conditions shall fulfill above-mentioned conditions.

One example for forming the minute projections 132 on the roller 131 of FIG. 8 is shown below. After carrying out plasma jet flame coating of the ceramic to the material face (peripheral face) of the metal roller, the face of the metal roller can be ground, and many minute projections 132 can be further formed by laser engraving. A pitch of the minute projection 132 is preferable to 100 μm or less, more preferable to 30 μm or less. A depth of laser engraving is set to 3-40 μm, the minute projections 132 of 70%-200% of height of film thickness are formed on the roller 131, thus the roller 131 is made as a templating roller.

The 1st advantage using a roller as a templating body is that surface hardening is easy compared with the case where it considers as a belt. In other words, the belt coated by ceramic is difficult to use due to a lack of flexibility, however, in the case of the roller, flexibility is not required. The 2nd advantage using a roller as an embossing body is that highly precise endless processing is easy. It is difficult to carry out endless processing welding of the belt so that the surface micro-processing pattern continues.

One example for forming the minute projections 133 on the metal belt 134 of FIG. 9 will be described as follows. Many minute projections 133 can be formed in the metal plate with a thickness of 0.1 mm-0.5 mm by photo etching. Also in this case, a pitch of the minute projection 133 is preferable to 100 μm or less, more preferable 30 μm or less. A depth of said photo etching is set to 3-40 μm, the minute projections 133 of 70%-200% of height of film thickness are formed on the belt 134, thus the belt 134 is made as a templating belt.

An advantage using the belt as a templating body is that it can be easily made a long size body compared with the case where it considers as a roller. If it becomes a long size body, the following two points are advantages. For the 1st point, since the stencil sheet processing area increases per 1 round of the belt, the film processing of the amount of the purposes can be performed by a few of repeats, wear of the minute projections of the part decreases and the life of the belt becomes long. For the 2nd point, since the film after processing can be in contact with the belt in a long time, heat setting can fully be performed in the meantime. On the other hand, a carrying out endless processing welding of the belt needs advanced welding technology. However, since it is not necessary to form minute projections in the joint portion of the stencil plate and the stencil plate when producing the stencil sheet with which the length per edition was decided, if it is made for the welding part to serve as the joint portion, it will become unnecessary to consider as endless processing welding, and the problem will be solved.

In addition, when the working temperature is set to t° C., the melting point of the film is set to m° C. and the glass transition point of the film is set to g° C., the templating can be performed by P Pa of working pressure force of $10^4 \times 10^{2(m-t)/(m-g)}$ or more so that a useable stencil sheet is obtained. That is cleared through the experiment.

In accordance with the conveyance path of the stencil sheet 12, anyone of the compositions of FIG. 9 or FIG. 10 is arranged and then the composition of FIG. 1 is arranged, thereby, a series of plate-making apparatus are composed. Moreover, this stencil printing machine according to the present invention can also consist of building this plate-making apparatus into the stencil printing machine as a plate-making section.

With the plate-making method for stencil printing performed as mentioned above, since the stencil sheet consists of only thermoplastic resin film, a lamination with a supporter becomes unnecessary. Therefore, an inconvenience due to have the supporter is removed. For example, the lamination process becomes unnecessary. Adhesives become unnecessary. A bad influence to print qualities, such as "deformation of ink-permeating opening" etc. which adhesives bring to plate-making, is lost. A bad influence in which a fiber of a supporter enters in an opening of a perforated film, and produces, like "graze of printing" is lost. Although it will become the cause which produces curls if different-kind of materials are stuck, such a property that is easy to curl is removed. In the case of the lamination structure, ink which had been absorbed by the supporter was useless, but in the case of a structure only with a film, such futility of the ink is lost because the film is not equipped with any supporter having a thickness about 20 to 30 times the thickness of the film.

Moreover, in the case of the conventional supporter lamination composition, although the thickness of the film itself was about 1.5 μm, but in the case of the structure only with the film according to the present invention, it is possible to actually handle the film since the film has a certain amount of thickness, for example 4 to 5 μm (thickness grade of the cassette tape for sound) or more responding to a hardness of a material quality more. If another word is carried out, when the thickness of the stencil sheet is the thickness of only the film (about 1.5 μm) in the case of lamination structure, the stencil plate itself will be too thin and it will be hard to deal with it. In the present invention, since the thickness of the film itself is not as thin as the thickness in the conventional supporter lamination composition, it can effectively prevent back projection and carrying out a strike-through caused by transferring of superfluous ink to a print sheet.

In the case of the conventional lamination stencil sheet, since the thermoplastic resin film with a thickness of about 1.5 μm is perforated by heating of the thermal head, thermoplastic resin film with a thickness of 4-5 μm or more can not be perforated by heating of the same thermal head due to insufficiency of the out put of the thermal head. Moreover, if the output of the thermal head is enlarged, high heat energy gets across to a platen roller; thereby a bad influence attains the platen roller, and is not preferable for a life of the thermal head itself. However, by the method for plate-making according to the present invention, although it is based also on a kind of film material, a certain amount of thickness is given at least so as to easily handle it and the heat energy which is required in perforating does not become large compared with the conventional case. The reason is that many minute recesses are formed on one side of the film. Thereby, an ink-permeating opening can be obtained from the opposite side only by fusing the film to the grade which communicates with the minute recess in the part to perforate.

Conventionally, in the case of a stencil sheet only with a thermoplastic resin film, it is difficult to deal with the stencil sheet if the thickness of the film is not made to some extent thick, it is necessary to enlarge the output of the thermal head for thermally perforating. This is the greatest problem of utilization. According to the present invention, it becomes possible to thermally perforate the ink-permeating opening to the film without increasing of the output of the thermal head, and it can solve this problem.

It is preferable that the heat energy transmitted to the platen roller, which counters the thermal head on both sides of the thin thermoplastic resin film, is small as much as possible. As for this, it becomes possible to make the energy transmitted from the thermal head to the platen small enough since the output of the thermal head becomes small and the minute recess forms a heat insulation air space.

In particular, since the thermoplastic resin film is extended and an internal tensile stress at the time of the extension remains in the film, a crack occurs only by a thermal fusion of a few portions, and an opening which arrives at the minute recess of the neighborhood of it is formed. Therefore, it is not necessary to heat until a melting part arrives at the minute recess, and the output of the thermal head can be still miniaturized. Thus, in order to carry out the internal remains of the tensile stress at the time of the extension, it is necessary that a mechanical processing, such as a mold pressing processing which forms the minute recess, must be performed below at the melting point temperature of thermoplastic resin. In addition, it is preferable that the working temperature is higher than the glass-transition-point temperature of thermoplastic resin, in order to form the recess by the fewer working pressure force, preventing the crack of the film.

Moreover, the plate-making method of the present invention can be performed using by the plate-making apparatus for stencil printing. The thermoplastic resin film with uniform predetermined thickness is supplied in the apparatus, and the recesses are formed on one side surface of the fed film. Then, an opposite side surface of the film is heated by the thermal head generating a low energy heat so that an ink permeable opening is formed to make plate. A series of these operations may be performed by independent plate-making apparatus, and may be performed within the stencil printing machine equipped with such plate-making apparatus as the plate-making section.

INDUSTRIALLY APPLICABILITY

The plate-making method and apparatus for stencil printing and the stencil printing machine are utilized in a technical field of stencil printing.

The invention claimed is:

1. A plate-making method for stencil printing comprising:

forming a plurality of minute recesses in one side of a heat-sensitive stencil plate material for stencil printing, the plate material comprising a thermoplastic resin film with a predetermined thickness, wherein forming the minute recesses forms an internal tensile stress in the film and each recess forms a thin portion of the film having a thickness less than the predetermined thickness; and heating an opposite side of the film with a thermal head sufficiently to fuse-penetrate a thin portion of the film, but insufficiently to fuse-perforate the predetermined thickness of the film, so that said openings are formed by the heated fused-penetrated portion communicating with the minute recess;

wherein two or more heaters are arranged in a main scanning direction at one sequence or tier on the thermal head, when a main scanning side array pitch of the heater is set to PM, a main scanning side heater length is set to HM, a sub scanning side delivery pitch is set to PS and a sub scanning side heater length is set to HS, the heater size satisfies HM>0.6 PM and HS>0.7 PS so as to distribute two or more minute recesses in such area of the film that is in contact with one heater section of the thermal head.

2. A plate-making method for stencil printing according to claim 1, wherein the thickness of the stencil sheet is about several μm, the diameter of the minute recess is substantially 20 μm, and the pitch between the minute recesses is less than or equal to 100 μm.

3. A plate-making method for stencil printing according to claim 2, wherein an impression energy of the thermal head is 35 milli-joule/$mm^2$ or less.

4. A plate-making method for stencil printing according to claim 2, wherein said stencil plate material is constituted of an extended polyethylene-terephthalate (PET) film or an extended low melting point film by copolymerizing polyethylene terephthalate (PET) and polybutylene terephthalate (PBT), the minute recesses are formed on the one side of the film by templating, and a working temperature is set to t° C., the melting point of the film is set to m° C. and the glass transition point is set to g° C., and said templating is performed at a working pressure of $10^4 \times 10^{2(m-t)/(m-g)}$ Pa or more.

5. A plate-making method for stencil printing according to claim 2, wherein a diameter of an opening on the opposite side of the film is smaller than a diameter of an opening on the one side.

6. A plate-making method for stencil printing according to claim 2, wherein said thin portion is 80% or less of the predetermined thickness.

7. A method of forming a stencil plate for use in stencil printing the method comprising:

forming a plurality of recesses in a first side of a thermoplastic resin film having a predetermined thickness, each recess forming a thin portion of the film between a bottom of each recess and a second side of the film, the second side being opposite the first side; and heating the second side of the film to perforate thin portions, wherein the heating is insufficient to perforate the predetermined thickness of the film, and each perforated thin portion forms an opening extending through the film from the first side to the second side;

wherein forming the plurality of recesses comprises randomly forming the plurality of recesses in the first side of the film;

wherein a diameter of each opening on the first side is larger than a diameter of each opening on the second side;

wherein heating the second side comprises scanning the second side of the film relative to a thermal head comprising an array of heaters extending in a scanning direction and a subscanning direction, the subscanning direction being perpendicular to the scanning direction;

wherein a pitch of the plurality of the heaters in the scanning direction is PM, a length of each heater in the scanning direction is HM, a pitch of the heaters in the subscanning direction is PS, a length of each heater in the subscanning direction is HS, and each heater has a size satisfying a condition of HM>0.6 PM and HS>0.7 PS so as to distribute two or more minute recesses in such area of the film that is in contact with one heater section of the thermal head.

8. A method according to claim 7, wherein scanning the second side of the film relative to the thermal head comprises impressing the thermal head to the second side of the film.

9. A method according to claim 8, wherein an impression energy of the thermal head is 35 milli-joule/$mm^2$ or less.

10. A method according to claim 7, wherein forming the plurality of recesses comprises embossing the first side of the film.

11. A method according to claim 10, wherein said film comprises an extended polyethylene-terephthalate (PET) film or an extended low melting point film by copolymerizing polyethylene terephthalate (PET) and polybutylene terephthalate (PBT), and the embossing is performed at at least $10^4 \times 10^{2(m-t)/(m-g)}$ Pa, wherein m is a melting point of the film in ° C., t is a working temperature at which the embossing is performed in ° C., and g is a glass transition temperature of the film in ° C.

12. A method according to claim 7, wherein an average pitch of the recesses in the scanning direction is less than the pitch of the plurality of the heaters in the scanning direction.

13. A method according to claim 7, wherein a thickness of the thin portion is 80% or less of the predetermined thickness of the film.

14. A method of forming a stencil plate for use in stencil printing, the stencil plate comprising a thermoplastic resin film having a plurality of recesses in a first side of the film and a predetermined thickness, each recess forming a thin portion of the film between a bottom of each recess and a second side of the film, the second side being opposite the first side, the method comprising:

heating the second side of the film to perforate thin portions, wherein the heating is insufficient to perforate the predetermined thickness of the film, and each perforated thin portion forms an opening extending through the film from the first side to the second side;

wherein the plurality of recesses are randomly provided in the first side of the film;

wherein a diameter of each opening on the first side is larger than a diameter of each opening on the second side;

wherein heating the second side comprises scanning the second side of the film relative to a thermal head comprising an array of heaters extending in a scanning direction and a subscanning direction, the subscanning direction being perpendicular to the scanning direction;

wherein a pitch of the plurality of the heaters in the scanning direction is PM, a length of each heater in the scanning direction is HM, a pitch of the heaters in the subscanning direction is PS, a length of each heater in the subscanning direction is HS, and each heater has a size satisfying a condition of HM>0.6 PM and HS>0.7 PS so as to distribute two or more minute recesses in such area of the film that is in contact with one heater section of the thermal head.

15. A method according to claim 14, wherein scanning the second side of the film relative to the thermal head comprises impressing the thermal head to the second side of the film.

16. A method according to claim 15, wherein an impression energy of the thermal head is 35 milli-joule/$mm^2$ or less.

17. A method according to claim 14, wherein an average pitch of the recesses in the scanning direction is less than the pitch of the plurality of the heaters in the scanning direction.

* * * * *